US005351341A

United States Patent [19]

Broersma

[11] Patent Number: 5,351,341

[45] Date of Patent: Oct. 4, 1994

[54] MULTIPLE DENSITY HELMET BODY COMPOSITIONS TO STRENGTHEN HELMET

[75] Inventor: Lester V. Broersma, Bellflower, Calif.

[73] Assignee: Bell Sports Inc., Norwalk, Calif.

[21] Appl. No.: 934,200

[22] Filed: Aug. 24, 1992

Related U.S. Application Data

[63] Continuation-in-part of Ser. No. 717,485, Jun. 19, 1991.

[51] Int. Cl.[5] ..... A42B 3/02

[52] U.S. Cl. ..... 2/412; 2/421; 2/425

[58] Field of Search ..... 2/421, 425, 410, 411, 2/412, 414, 189, 338

[56] References Cited

U.S. PATENT DOCUMENTS

| | | | |
|---|---|---|---|
| 938,281 | 10/1909 | Shaw | 2/189 |
| 2,814,043 | 11/1957 | Alesi | 2/421 |
| 2,908,943 | 10/1959 | Miller . | |
| 3,327,316 | 6/1967 | Pukish, Jr. . | |
| 3,500,473 | 3/1970 | Marchello . | |
| 3,501,772 | 3/1970 | Wyckoff . | |
| 3,797,040 | 3/1974 | Caldwell . | |
| 4,006,496 | 2/1977 | Marker . | |
| 4,075,717 | 2/1978 | Lemelson . | |
| 4,115,874 | 9/1978 | Hasegawa . | |
| 4,134,155 | 1/1979 | Robertson . | |
| 4,446,576 | 5/1984 | Hisataka . | |
| 4,612,672 | 9/1986 | Schrack . | |
| 4,710,984 | 12/1987 | Asper et al. . | |
| 4,744,107 | 5/1988 | Fohl . | |
| 4,821,345 | 4/1989 | Marchello . | |
| 4,903,348 | 2/1990 | Broersma | 2/421 |
| 4,970,729 | 11/1990 | Shimazaki . | |

FOREIGN PATENT DOCUMENTS

| | | | |
|---|---|---|---|
| 2525084 | 10/1983 | France | 2/421 |

*Primary Examiner*—Peter Nerbun
*Attorney, Agent, or Firm*—William W. Haefliger

[57] ABSTRACT

A protective helmet having dome-shaped body means, the combination comprising a retention strap associated with the body means; and a first cavity in the body means in which a substantial length of the strap is stored in position to be pulled out of the cavity for use in retaining the helmet to the head of a user.

40 Claims, 5 Drawing Sheets

FIG. 7.
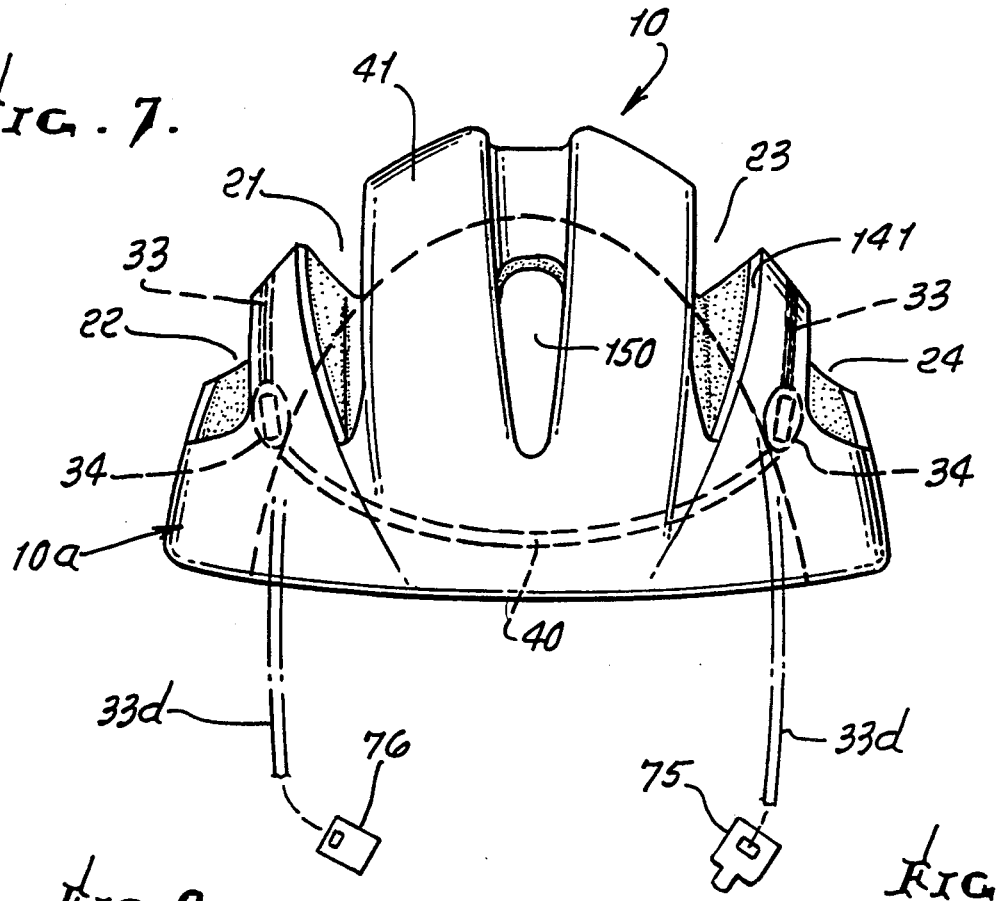
FIG. 8.
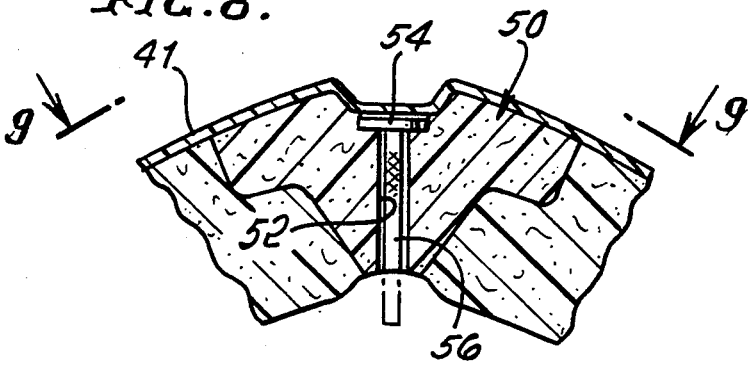
FIG. 10.
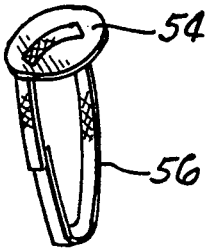
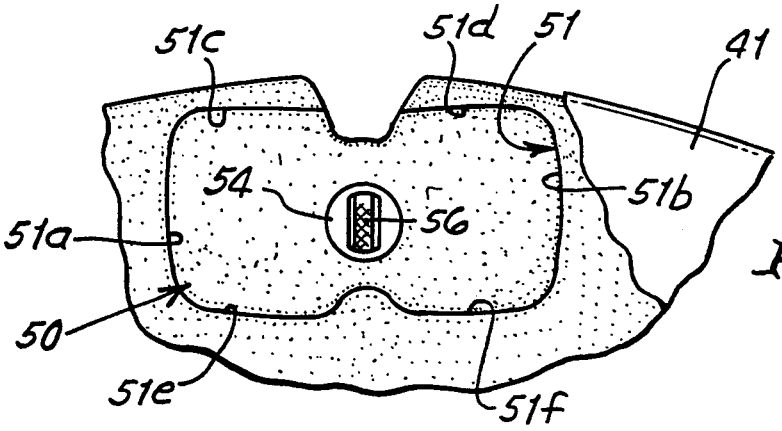
FIG. 9.

FIG. 11.
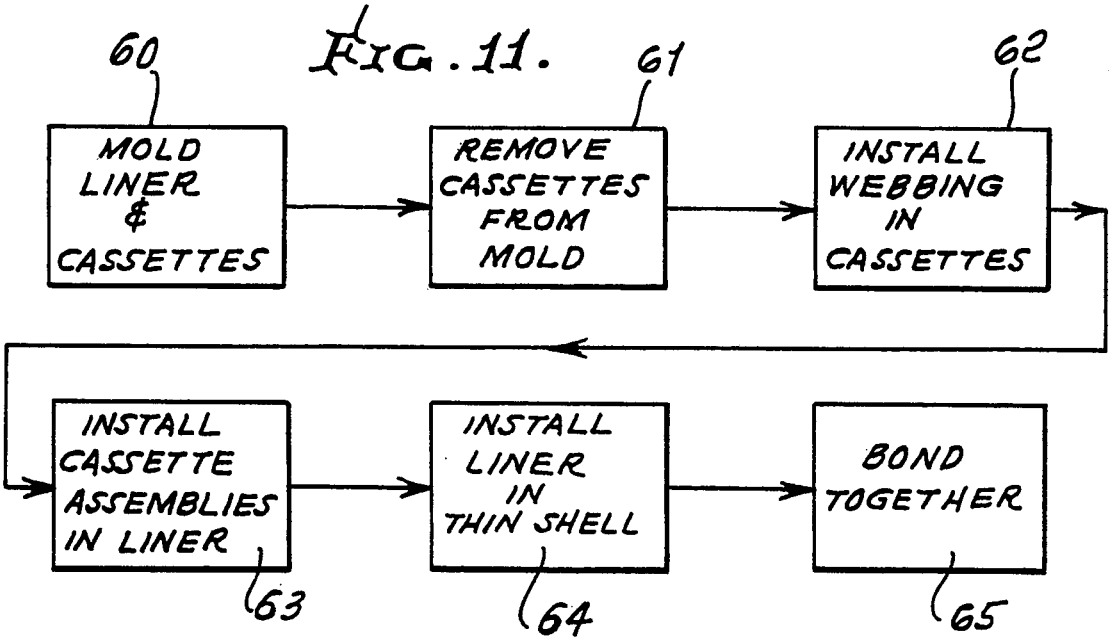
FIG. 12.
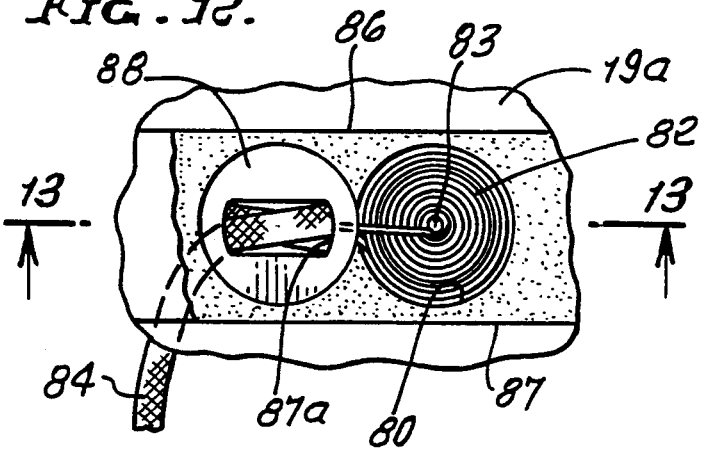
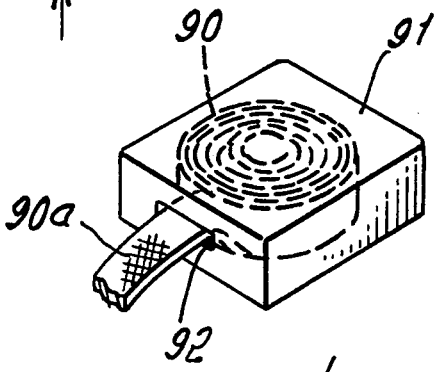
FIG. 14.
FIG. 13.
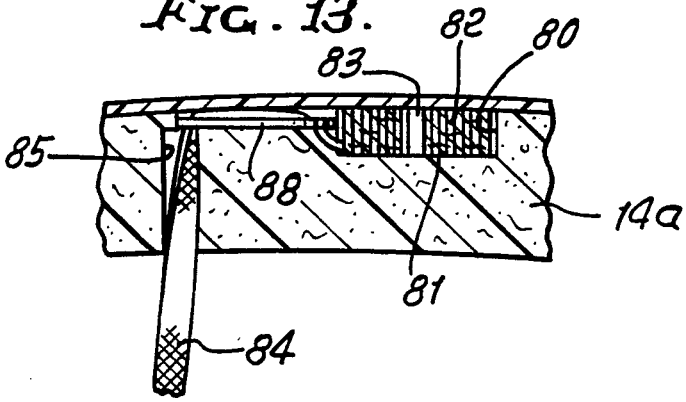

MULTIPLE DENSITY HELMET BODY COMPOSITIONS TO STRENGTHEN HELMET

This application is a continuation-in-part of Ser. No. 717,485 filed Jun. 19, 1991.

BACKGROUND OF THE INVENTION

This application relates generally to helmets, and more particularly to helmet structures worn by cyclists and having retention straps for retaining the helmets to the heads of cyclists.

Safety helmets, as worn by bicyclists, motorcyclists, skaters, and others, typically employ a thick (20 to 50 mm) layer of crushable, synthetic resin foam, extending over and about the wearer's head to mitigate impact. In many designs, ventilation openings or holes are formed to extend in or through the helmet body. It was found that such holes reduced the impact strength of the helmet body, and particularly proximate the holes. In order to prevent reduction in impact strength, a stiff, outer shell was employed, the helmet body itself would be made thicker, or the entirety of the crushable foam would be made of higher density material. However, all of these approaches increase substantially the overall weight of the helmet. No way was known to achieve increased strength, without increasing helmet body thickness or weight.

Further, when safety straps are to be anchored to the helmet body, it was necessary to thread the straps through holes in the main body of the helmet after it was molded, which was time consuming. There was no way to mold the main body with the straps already installed in position in the main body.

SUMMARY OF THE INVENTION

It is a major object of the invention to provide solutions to the above problems and apparatus, and in a manner such as to achieve strap preinstallation, to reduce strap assembly time; and to achieve increased helmet body strength, particularly at helmet strap openings and proximate air vents molded into the helmet dome-shaped body. The method of the invention basically includes the steps:

a) providing a first retention strap, b) forming a first cavity in the dome-shaped body of a size to receive a substantial length of the strap in stored position, c) and inserting the substantial length of the strap in stored condition in the first cavity, to be subsequently pulled out of the cavity for use in retaining the helmet to the head of a wearer.

Typically, the dome-shaped body comprises at least two sections consisting of foamed synthetic resin, one section forming the first cavity and the other of which is formed by molding to the one section. After completion of molding the main length of the stored strap may be pulled out of the cavity, in the one section (i.e. "cassette") the retained portion of the strap being held against pull-out.

It is another object of the invention to provide multiple helmet body sections of foamed resin, and which have different densities, the section or sections containing the strap storage cavity, or cavities, being of higher density, and therefore having increased strength, whereas another body section has lower density.

A further object of the invention is to provide a protective outer shell, which is fitted over the multiple body sections in protective relation to the strap storage cavity or cavities.

Yet another object is to form strap storing cavities in different body section molded recesses or cavities, which are inserted into a mold for molding additional body resin to the inserted section or sections, thereby forming the integrated and completed unitary dome-shaped body.

An additional object includes the step of initially molding the body cavities with storage cavities therein, and installing straps in stored configuration in the cavities, with strap ends exposed for pull-out after completed molding of the helmet body. Portions of the straps are typically held or anchored in the cavities to prevent complete pull-out, as will appear.

Further objects include the formation of strap storage cavities of different configurations, for example to store the straps in elongated configuration, or gathered configuration, in the storing cavities or body sections.

Yet another object is to provide a helmet apparatus embodying a strap storage cavity or cavities, as for example in a pre-molded section or sections; and helmet air vents may be integrated in such sections, as will appear.

These and other objects and advantages of the invention, as well as the details of an illustrative embodiment, will be more fully understood from the following specification and drawings, in which:

DRAWING DESCRIPTION

Figure 1:
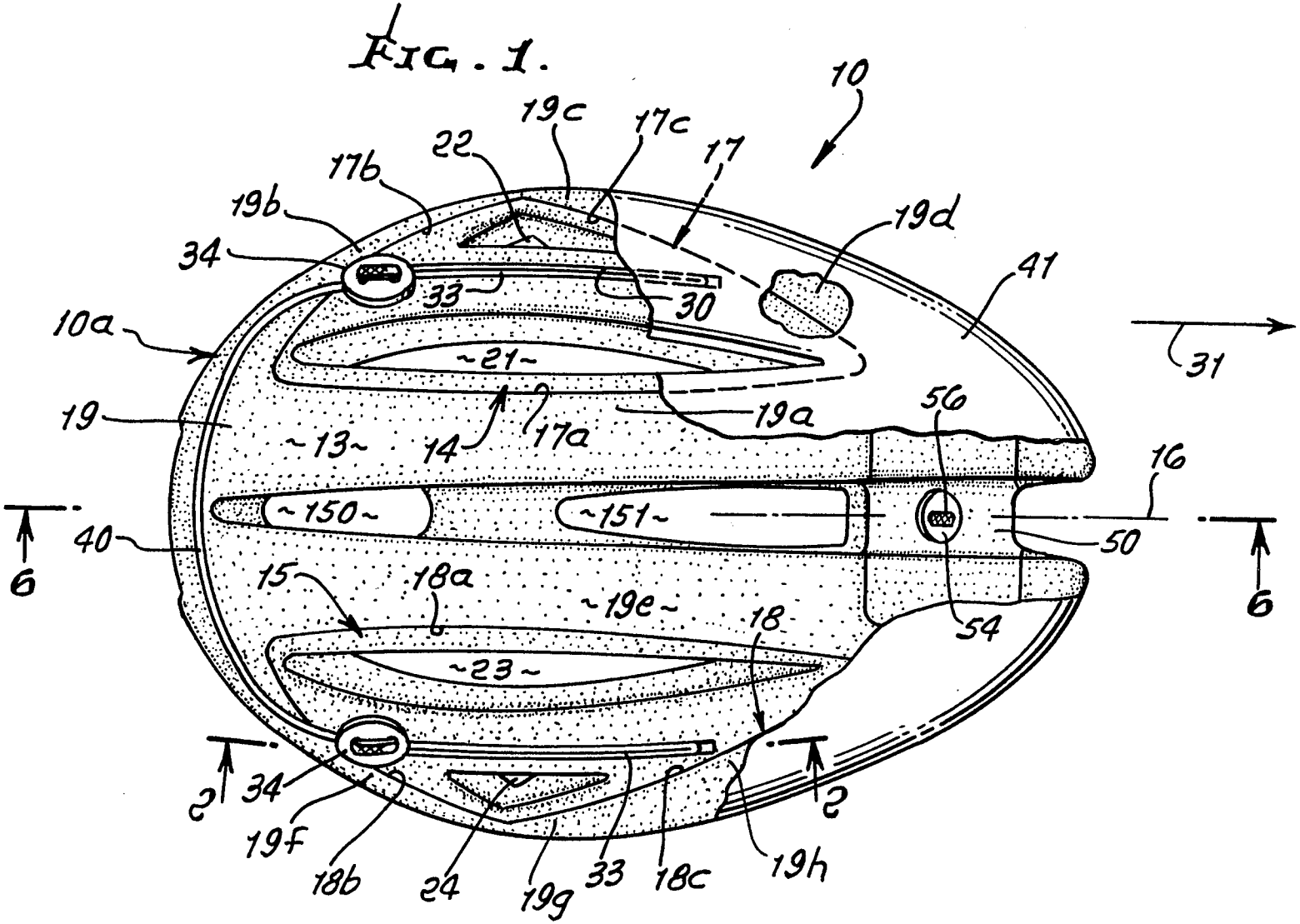
FIG. 1 is a top plan view of one form of helmet embodying the invention.
Figure 2:
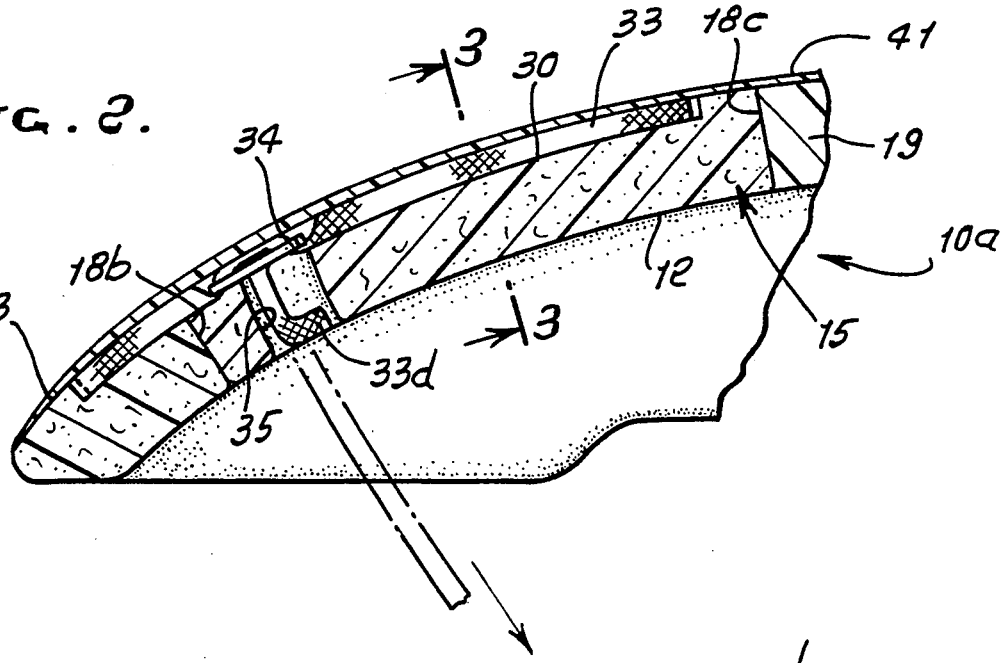
FIG. 2 is an enlarged fragmentary section taken on lines 2—2 of FIG. 1.
Figure 3:
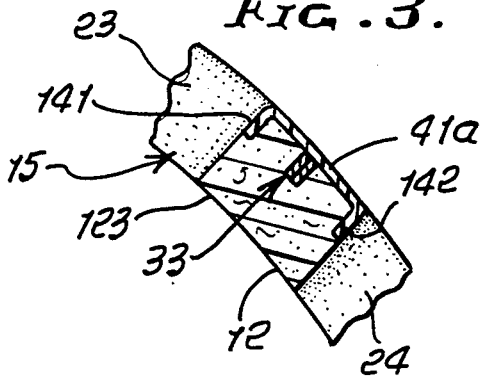
FIG. 3 is a fragmentary section taken on lines 3—3 of FIG. 2.
Figure 4:
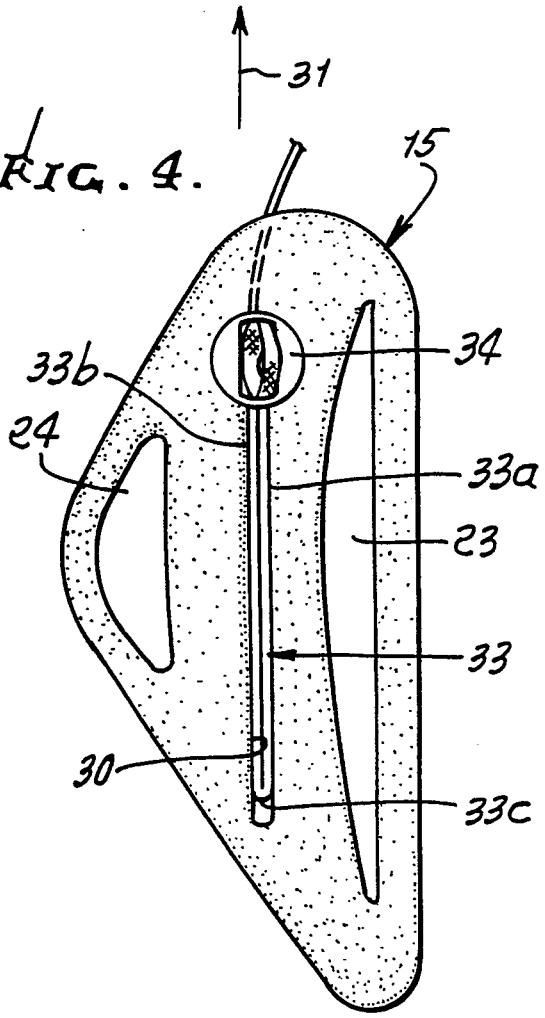
Figure 3A:
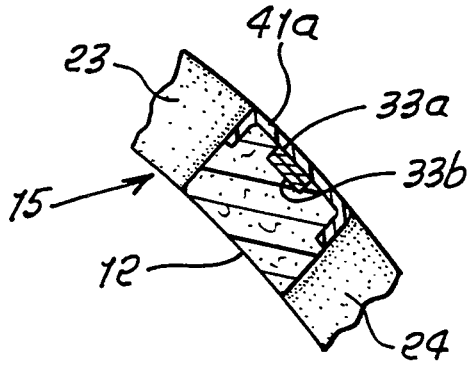
Figure 5:
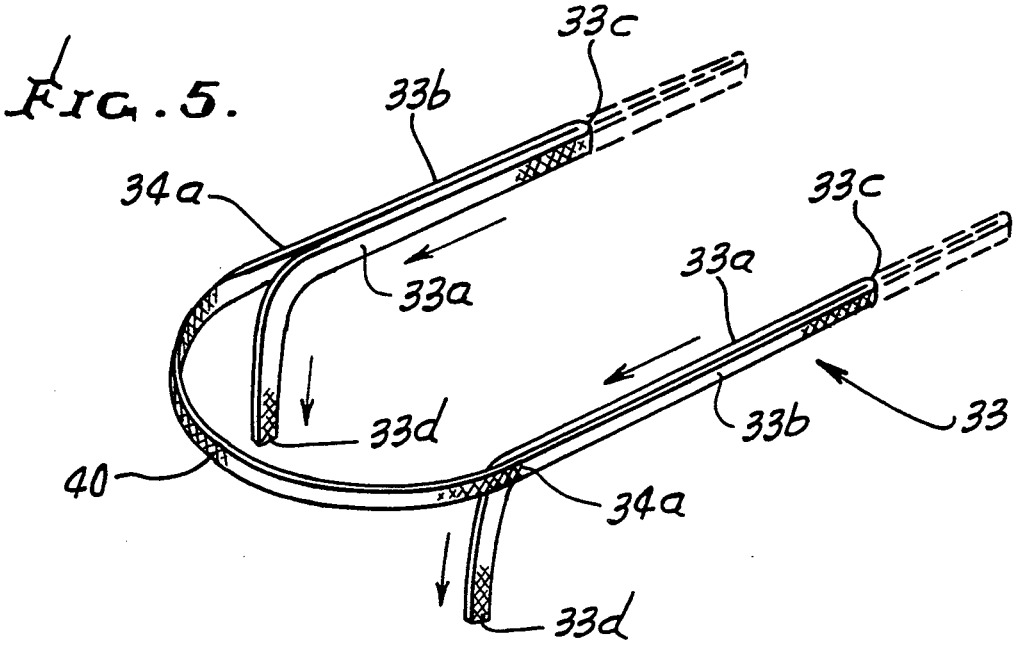
Figure 6:
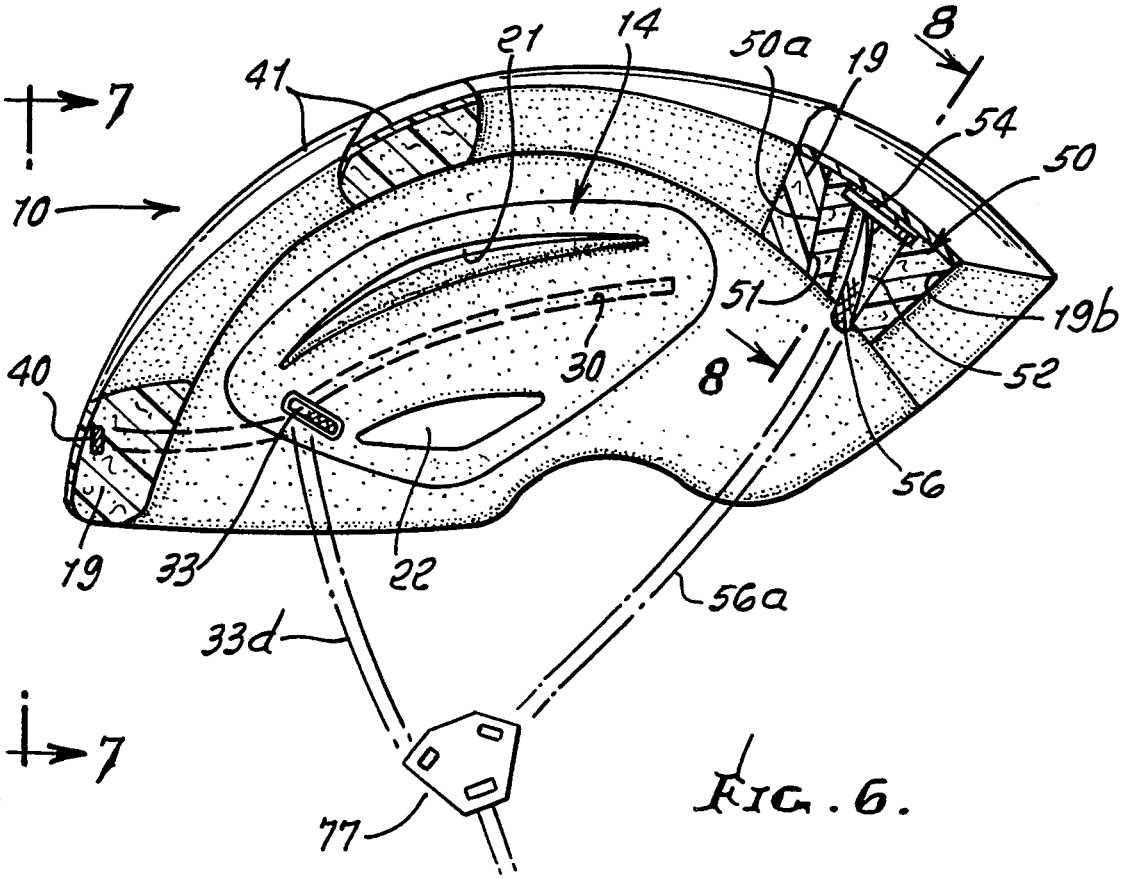

FIG. 3*a* is a section like FIG. 3, but showing a variation;

FIG. 4 is a top plan view of a section or cavity to be employed in the FIG. 1 helmet;

FIG. 5 is a perspective view of a stored strap;

FIG. 6 is a section taken in elevation on lines 6—6 of FIG. 1;

FIG. 7 is a frontal elevation taken on lines 7—7 of FIG. 6;

FIG. 8 is an enlarged fragmentary section taken on lines 8—8 of FIG. 6;

FIG. 9 is a top plan view taken on lines 9—9 of FIG. 8;

FIG. 10 is a perspective view of a strap anchor means;

FIG. 11 is a block diagram showing helmet forming steps;

FIG. 12 is a top plan view of an alternate gathered storage method;

FIG. 13 is a section taken on lines 13—13 of FIG. 12; and

FIG. 14 is a perspective view of a strap storage section formed as a block.

DETAILED DESCRIPTION

In the drawings, the bicycle helmet 10 includes generally dome-shaped, foamed plastic "liner" body structure or means 10*a* having inner and outer sides 12 and 13. The body structure may consist of polystyrene or like material. In accordance with the invention, the body structure includes a main body portion 19 defining a cavity or cavities for reception of one or more insert body portions. See for example the similar "mirror image" insert body portions or "cassettes" 14 and 15 equally spaced at opposite sides of a vertical plane 16 that extends front to rear and bisects the helmet at its center. Those cassettes 14 and 15 are located or received in cavities 17 and 18, respectively, and defined by walls 17*a*–17*c*, and 18*a*–18*c* as shown in FIG. 1. Thus, the main body portion 19 bounds the cassettes or insert body portions at regions 19*a*–19*h*.

Insert body portion 14 defines two through air vent openings 21 and 22 which extend or are elongated generally forwardly and rearwardly; and insert body portion 15 defines two through air vent openings 23 and 24 which extend or are elongated generally forwardly and rearwardly, and are mirror images of 21 and 22.

While a specific body structure 10*a* and specific cassettes 14 and 15 have been described, they may take different forms, shapes and designs.

In accordance with the invention, a retention strap is associated with the body means 10*a*, the latter forming a cavity in which a substantial length of the strap is stored in position to be pulled out of its cavity for use in retaining the helmet to the head of the user. Further, that portion of the strap retained in the cavity may be anchored therein, as will be described.

In FIGS. 1–4, a first cavity comprises a slot 30 elongated in the cassette 14 in a forward direction, (see arrow 31) as for example between the two vents 21 and 22. A strap is shown at 33, having its major length extending in the slot as two elongated strap stretches 33*a* and 33*b*, connected at 33*c*. See FIG. 5. A flat anchor disc 34 seats on the outer surface of 14, proximate one end of the slot, and the strap has an end portion 33*d* loop-attached to the disc. The opposite end portion 33*d* of the strap is received in a through opening 35 in the cassette 14, to be accessible for pull-out after the body main portion and the two cassettes are integrated, as by molding. Note that the elongated slot 30 extends only part way into the cassette body, whereby the strap is stored therein until pull-out. Such insertion of the strap into the position seen in FIGS. 1–4 is effected after separate molding of the cassette, and prior to its integration with the main body portion 19, as by molding, or adhesive joining of the perimeter of the cassette with the bounding walls of cavity 17. The second, mirror image cassette 15 also has an anchored strap retained in a slot, like that described for cassette 14, and the same identifying numerals are applied to it. Both straps may be integrated at 40, as one strap, as seen in FIG. 5. In that event, the cassette body portion is molded over the U-shaped strap extent, after the two cassettes 14 and 15 are first placed in the mold. Thus, 40 is embedded in 19.

After integration of the cassettes 14 and 15 and main body portion 19, a thin outer dome-shaped shell 41 is placed downwardly over 14, 15, 19 and the slots and stored strap or straps, to cover and conceal the latter. The thin outer shell 41 is fastened in position, as by bonding to 19, or by taping its lower perimeter to the lower outer side of 19. FIG. 11 shows in block form the steps of the method of forming the assembled helmet components, numbered at 60–65. Steps 53 and 54 may be performed as by adhering the cassette peripheries to the cavity walls 17 of the main body portion 19, or by molding the main body portion 19 to the cassette after pre-placement of the latter in the mold for 19.

Another feature of the invention concerns forming the insert or cassette body portions 14 and 15 of foamed plastic material of higher density than the density of the main body portion 19. This provides higher strength at the locations of imposed strain (webbing pull) and of structural weakness (vents). Such higher density plastic material and its use are described in my co-pending application Ser. No. 717,485, filed Jun. 19, 1991, and incorporated herein by reference.

Referring to FIGS. 5 and 6, they show the method or disposition of the stored lengths of straps or webbing, as during pull-out. The end portions of 33*d* of the straps are shown being pulled downwardly in FIG. 5, from slots seen in FIG. 2. The strap lengths 33*b* may be considered as anchored in the helmet shell, at locations 34*a*, since auxiliary length 40 extends across the end of the helmet (front end, for example), and may be held in position by the body portion 19, or by the thin outer shell 41. See also FIG. 1. The strap extents pulled from stored condition may be connected to buckle tongue and receptacle parts 75 and 76, which are interconnectible by the helmet user.

FIGS. 3 and 7 show the thin outer shell 41 portion 41*a* overlying cassette extent 123 between vents 23 and 24, and with downwardly extending protective flanges 141 and 142. In FIG. 3*a* the tape extents 33*a* and 33*b* lie parallel to side 12. Additional central vents are seen at 150 and 151.

Also shown in FIGS. 1, 6 and 9 is another insert body portion or cassette 50 of the same denser foam material as referred to for inserts 14 and 15. It is located at the rearward end of the helmet, and its looping perimeter 50*a* is attached (by molding or adhesive) to the corresponding looping wall 51 of a cavity formed in main body portion 19. See in FIG. 9 the wall 51 sections 51*a*, 51*b*, 51*c*, 51*d*, 51*e* and 51*f*. Located in 50 is a through opening 52 which receives a stored length or lengths of a webbing or strap 56 prior to attachment of 50 to 19. The strap is anchored at one end in position as by a metal disc 54 to which the strap is attached. See the strap in the form of a loop to be pulled free from stored condition and connected by auxiliary straps 56*a* to Y-shaped elements 77 (see FIG. 6) to which straps 33*d* are also connected. FIG. 10 shows the looping straps 56 anchored to disc 54. The thin outer shell 41 covers cassette 50.

FIGS. 12 and 13 show an alternative means for storing a strap in the body of the helmet cavity. Note the cylindrical well or recess 80 in a cassette body 14*a*, and having a bottom wall 81, and the strap 82 coiled in stored condition in the well. One end of the strap is attached to a pin 83 in the well. The other end 84 of the strap hangs free from a passage 85 through the cassette body 14*a* after attachment of the cassette body to the main body 19*a*, as at edges 86 and 87. The strap end 84 is pulled down, which causes the coiled strap to feed out of storage. A metering disc 88 may be provided between well 80 and passage 85 to frictionally pass the uncoiling strap through slots 87*a* in the disc. This prevents initial inadvertent pullout of the strap.

In FIG. 14, a strap 90 is held in coiled and stored condition in a receptacle 91, and feeds out through a slot 92 in the receptacle wall when free end 90*a* is pulled. The receptacle may be molded into a cavity in the wall of a helmet main body portion 19, as described.

I claim:

1. In a protective helmet having dome-shaped body means, the combination comprising a) a retention strap within said body means, b) a first cavity in said body means in which a substantial length of said strap is stored in position to be progressively pulled out of said cavity for use in retaining the helmet to the head of a user, and characterized in that the strap has certain portions thereof remaining immovable in the cavity as other portions of the strap move out of the cavity, c) said body means proximate said first cavity consisting of foamed synthetic resin.

2. The combination of claim 1 wherein said body means includes a main body portion defining a second cavity, and an insert body portion retained in said second cavity, said insert body portion defining at least part of said first cavity.

3. The combination of claim 2 wherein said main body portion is molded about said insert body portion in retaining relation therewith.

4. In a protective helmet having dome-shaped body means, the combination comprising a) a retention strap within said body means, b) a first cavity in said body means in which a substantial length of said strap is stored in position to be pulled out of said cavity for use in retaining the helmet to the head of a user, c) said body means including a main body portion defining a second cavity, and an insert body portion retained in said second cavity, said insert body portion defining at least a part of said first cavity, d) and wherein said insert body portion and main body portion both consist of foamed synthetic resin; one of said portions having higher density than the other.

5. The combination of claim 4 wherein said insert body portion has higher density than said main body portion.

6. The combination of claim 5 wherein said main body portion is molded about said insert body portion in retaining relation therewith.

7. In a protective helmet having dome-shaped body means, the combination comprising a) a retention strap within said body means, b) a first cavity in said body means in which a substantial length of said strap is stored in position to be pulled out from said cavity for use in retaining the helmet to the head of a user, c) said body means including a main body portion defining a second cavity, and an insert body portion retained in said second cavity, said insert body portion defining at least a part of said first cavity, d) and wherein said insert body portion also defines air vent means in said helmet.

8. The combination of claim 1 wherein said first cavity comprises an elongated slot receiving an elongated length of said retention strap.

9. The combination of claim 1 wherein said first cavity comprises a well receiving a gathered length of said retention strap.

10. The combination of claim 1 including a protective outer shell fitting over said dome-shaped body means in protective relation to said first cavity.

11. The combination of claim 1 including an anchor engaging said body means proximate said first cavity, and to which said strap is connected, the stored strap having a free end accessible at a side of said body means to be grasped for pulling of said strap substantial length out of the first cavity.

12. The combination of claim 11 including a protective outer shell fitting over said dome-shaped body means in protective relation to said first cavity.

13. In a protective helmet having dome-shaped body means, the combination comprising a) multiple retention straps within said body means, and b) multiple first cavities in said body means and in which substantial lengths of said respective straps are stored, in position to be pulled out of said cavities for use in retaining the helmet to the head of a wearer, and characterized in that the strap has certain portions thereof remaining immovable in the cavity as other portions of the strap move out of the cavity, c) said body means proximate said cavities consisting of foamed synthetic resin.

14. The combination of claim 13 wherein said body means includes multiple sections retained in assembled relation, at least two of said straps retained in at least two of said cavities respectively, and said two cavities associated with at least two of said body means sections, respectively.

15. The combination of claim 14 wherein said body means includes at least a third section to which said two sections are assembled.

16. The combination of claim 15 wherein said sections consist of foamed synthetic resin.

17. In a protective helmet having dome-shaped body means, the combination comprising a) multiple retention straps within said body means, and b) multiple first cavities in said body means and in which substantial lengths of said respective straps are stored, in position to be pulled out of said cavities for use in retaining the helmet to the head of a wearer, c) said body means including multiple sections retained in assembled relation, at least two of said straps retained in at least two of said cavities, respectively, said multiple sections including at least two sections within which said at least two cavities, respectively, are located, d) and wherein said at least two sections each defines air vent means.

18. The combination of claim 13 including a protective outer shell fitting over said dome-shaped body means in protective relation to said multiple cavities.

19. The combination of claim 14 including a protective outer shell fitting over said body means in bridging relation to said multiple sections.

20. The combination of claim 13 wherein said stored straps have free ends accessible at a side of said body means to be grasped for pulling of said strap substantial lengths out of said cavities.

21. In a protective helmet having dome-shaped body means, the combination comprising a) multiple retention straps within said body means, and b) multiple first cavities in said body means and in which substantial lengths of said respective straps are stored, in position to be pulled out of said cavities for use in retaining the helmet to the head or a wearer, c) said body means including multiple sections retained in assembled relation, at least two of said straps retained in at least two of said cavities respectively, and said two cavities located within at least two of said multiple sections respectively, d) said body means including at least a third section to which said two multiple sections are assembled, e) and wherein said sections consist of synthetic resin, said third section being molded to said two sections to hold them in assembled relation.

22. The combination of claim 21 wherein said two sections have greater density than said third section.

23. In a protective helmet having dome-shaped body means, the combination comprising a) a retention strap within said body means, b) a first cavity in said body means in which a substantial length of said strap is stored in position to be pulled out of said cavity for use in retaining the helmet to the head of a user, c) said body means including a main body portion defining a second cavity, and an insert body portion retained in said second cavity, said insert body portion defining at least part of said first cavity, d) said insert body portion also defining air vent means in said helmet, e) and including a protective outer shell fitting over said dome-shaped body means in protective relation to said cavity, said outer shell forming air vent means in registration with the air vent means in said insert body portion.

24. The combination of claim 23 wherein said first cavity opens directly to said shell which covers said first cavity.

25. The combination of claim 24 wherein said air vent means is offset from said first cavity.

26. In a protective helmet having dome-shaped body means, the combination comprising a) multiple retention straps within said body means, and b) multiple first cavities in said body means and in which substantial lengths of said respective straps are stored in position to be pulled out of said cavities for use in retaining the helmet to the head of a wearer, c) said body means including multiple sections retained in assembled relation, at least two of said straps retained in at least two of said cavities respectively, and said two cavities located within at least two of said multiple sections, respectively, d) a protective outer shell fitting over said body means in bridging relation to said multiple sections, e) and including air vent means in said shell and in each said multiple sections.

27. In a protective helmet having dome-shaped body means, the combination comprising a) multiple retention straps within said body means, and b) multiple first cavities in said body means and in which substantial lengths of said respective straps are stored in position to be pulled out of said cavities for use in retaining the helmet to the head or a wearer, c) said body means including multiple sections retained in assembled relation, at least two of said straps retained in at least two of said cavities, respectively, said multiple sections including at least two sections within which said at least two cavities, respectively, are located, d) and wherein said at least two sections have greater density than another body section projecting away from said two sections.

28. In a protective helmet having dome-shaped body means, the combination comprising a) multiple retention straps within said body means, and b) multiple first cavities in said body means and in which substantial lengths of said respective straps are stored in position to be pulled out of said cavities for use in retaining the helmet to the head or a wearer, c) and wherein said body means includes first portions within said cavities and a main portion projecting from said first portion, said first portion having greater density than said main portion.

29. The combination of claim 28 including a thin protective outer plastic shell fitting over said dome-shaped body means including said first portions of greater density and said main portion which has relatively lower density, said outer shell and said first portions defining registered air vents extending between outer and inner sides of the helmet, said vents offset from said two strap storage cavities.

30. The method of forming and using a protective helmet, including the steps of a) molding a dome-shaped body means, b) providing a first retention strap, c) forming a first cavity in said dome-shaped body means of a size to receive a substantial length of said strap in stored position, d) and inserting said substantial length of said strap in stored condition in said first cavity, to be subsequently pulled out of said cavity for use in retaining the helmet to the head of a wearer, pulling a portion of said length of strap out of said cavity while other portions of said length of strap remain immovable in the cavity, e) said body means being molded to consist, proximate said first cavity, of foamed synthetic resin.

31. The method of forming a protective helmet including the steps of a) molding a dome-shaped body means, b) providing a first retention strap, c) forming a first cavity in said dome-shaped body means of a size to receive a substantial length of said strap in stored position, d) and inserting said substantial length of said strap in stored condition in said first cavity, to be subsequently pulled out of said cavity for use in retaining the helmet to the head of a wearer, and pulling a portion of said length of strap out of said cavity while other portions of said length of strap remain immovable in the cavity e) and wherein said first cavity is formed during molding of said dome-shaped body means.

32. The method of claim 31 wherein said dome-shaped body means consists substantially entirely of foamed synthetic resin.

33. The method of claim 32 wherein said dome-shaped body means comprises at least two sections, one of which forms said first cavity, and the other of which is formed by molding to said one section.

34. The method claim 33 including providing a protective outer shell, and fitting said shell over said sections.

35. The method of claim 33 including forming air vent means in said one section.

36. The method of claim 30 wherein said dome-shaped body means comprises two sections one of which forms said first cavity, and providing a protective outer shell and fitting said shell over said sections and in protective relation with said front cavity.

37. The method of claim 30 wherein said first cavity is formed to have elongation, and said strap is inserted in said cavity to have substantial elongated length in said cavity.

38. The method of claim 30 wherein said cavity is formed as a well, and said strap is inserted in said cavity to have gathered substantial length in said well.

39. The method of claim 30 including c) providing a second retention strap, d) forming a second cavity in said dome-shaped body means of a size to receive a substantial length of said strap in stored position, e) and inserting a substantial length of said second strap in stored condition in said second cavity, to be subsequently pulled out of said cavity for use in retaining the helmet to the head of a wearer.

40. The method of claim 39 wherein said dome-shaped body means comprises multiple sections, one of which forms said first cavity and a second of which forms said second cavity, said cavities formed during molding of said sections.

* * * * *